United States Patent [19]

Turetsky et al.

[11] 4,214,661

[45] Jul. 29, 1980

[54] POINT OF PURCHASE DISPLAY

[76] Inventors: Mark A. Turetsky, 598 Broadway, New York, N.Y. 10012; Robert E. Robbins, 337 Garden City St., Islip Terrace, N.Y. 11752

[21] Appl. No.: 34,034

[22] Filed: Apr. 27, 1979

[51] Int. Cl.[2] ..... B65D 73/00

[52] U.S. Cl. ..... 206/466; 206/476; 206/482; 206/493; 206/495

[58] Field of Search ..... 206/466, 472, 476–478, 206/482, 493, 495, 526

[56] References Cited

U.S. PATENT DOCUMENTS

| | | | |
|---|---|---|---|
| 793,045 | 6/1905 | Bronson | 206/482 X |
| 2,122,289 | 6/1938 | Legendre | 206/493 X |
| 2,270,393 | 1/1942 | Tate et al. | 206/493 X |
| 2,841,282 | 7/1958 | De La Fuente | 206/466 |
| 3,061,092 | 10/1962 | Hime et al. | 206/493 X |

FOREIGN PATENT DOCUMENTS

| | | | |
|---|---|---|---|
| 1492743 | 11/1977 | United Kingdom | 206/466 |

*Primary Examiner*—Joseph Man-Fu Moy
*Attorney, Agent, or Firm*—Blum, Kaplan, Friedman, Silberman & Beran

[57] ABSTRACT

A display card for holding and dispensing articles includes rows of attached, protruding, tear-off tabs formed by cutting and bending a sheet which is semi-rigid and tearable. The tabs are generally keyhole-shaped with the head end of the keyhole being rounded and the stem end remaining attached to the card when the tabs are formed. By flexing, the rounded tab end is inserted through a lesser diameter hole in the article for display, thereby locking the article to the card. The article which may be in form of a product or package for a product may be removed from the card by pulling which causes the tab to tear until it separates from the card. A transverse slit in the card below each tab limits the extent of tearing. Articles remain attached regardless of card orientation until the article is intentionally removed.

14 Claims, 5 Drawing Figures

POINT OF PURCHASE DISPLAY

BACKGROUND OF THE INVENTION

This invention relates generally to a display card for articles, generally packaged products, and more particularly to a display card where tabs hold the articles to the card until they are intentionally removed. Mass marketing techniques of the present day require that small packaged products be merchandised from display stands or cards which are uniquely associated with the product and are conveniently utilized at the point of sale. To make the product more attractive to the retailer, it is generally desirable to minimize the amount of effort required on the part of the retailer and his personnel in preparing the product for display and in selling. The display cards are located throughout the selling establishment, and frequently near check-out counters and cash registers, for example, in supermarkets where the product may benefit from impulse buying. Many racks and display cards have been developed for this purpose. However, most such displays require that the package product be loaded into or mounted to the display at the location for sale, and the display device must be refilled on a regular basis.

What is needed is a display device for packaged products which is delivered fully loaded with the product from the producer. It is also desirable that the display device be disposable after the product has been sold. Previous attempts at such devices have proved ineffective, impracticable or unnecessarily costly to produce.

SUMMARY OF THE INVENTION

Generally speaking, in accordance with the invention, a point of purchase display card for articles such as packaged products which is disposable and especially suitable for transporting with the product already in place, is provided. The display card of this invention for holding the articles includes rows of attached, protruding, tear-off tabs formed by cutting and bending a sheet which is semi-rigid and tearable, for example, cardboard. The tabs are generally keyhole-shaped with the head end of the keyhole being rounded and the elongated stem end remaining attached to the card when the tabs are formed. By flexing, the rounded tab end is inserted through a lesser diameter hole in the article for display thereby locking the article to the card. The article may be formed of rigid or flexible material and can be removed from the card by pulling which causes the tab to tear until it separates from the card. A transverse slit in the card located below each tab limits the extent of tearing and protects the appearance surface of the display card. Articles remain attached regardless of card orientation until the article is intentionally removed, thereby facilitating shipment from the producer of cards already bearing the article or packaged product. Thus, only minimum labor is required of the merchandiser in readying the product for sale.

Accordingly, it is an object of this invention to provide an improved display card for articles such as packaged products which retains the articles until they are intentionally removed regardless of orientation.

Another object of this invention is to provide an improved display card for articles which provide for easy loading, secure shipping, orderly and positive retention of the product and yet allows easy removal by the purchaser.

A further object of this invention is to provide an improved display card for articles which presents an attractive appearance even after the articles have been removed.

Still other objects and advantages of the invention will in part be obvious and will in part be apparent from the specification.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which.

DESCRIPTION OF THE PREFERRED EMBODIMENTS

Figure 1:
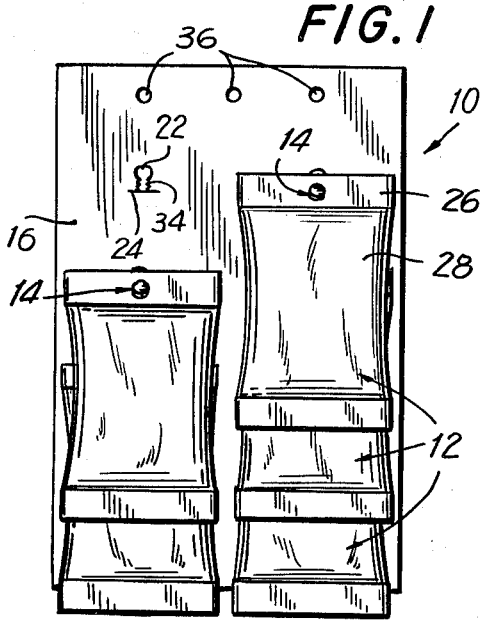
FIG. 1 is a front view of the display card of this invention showing the condition after one package has been removed.
Figure 2:
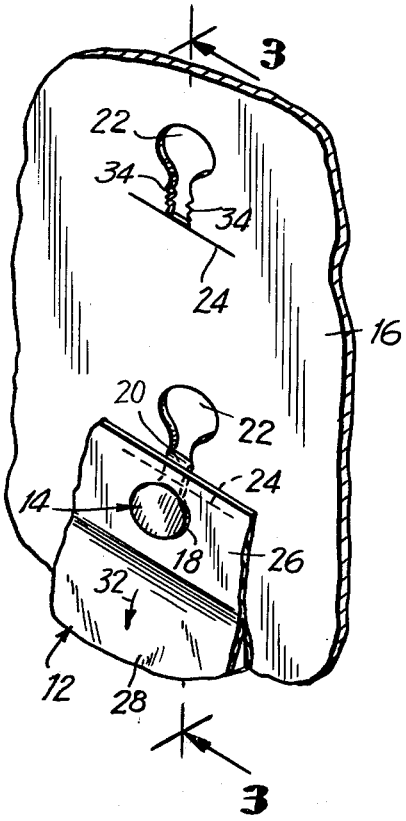
FIG. 2 is a perspective view to an enlarged scale of a fragment of the display card of FIG. 1.
Figure 3:
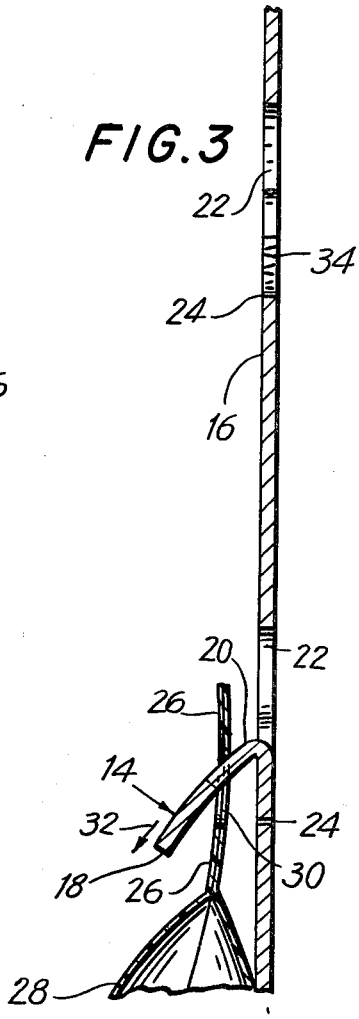
FIG. 3 is a sectional view taken along the line 3—3 of FIG. 3.

With reference to the FIGS. 1, 2 and 3, the display card 10 for articles such as packaged products 12 comprises a plurality of tabs 14 protruding from a sheet 16 of semi-rigid and tearable material. This sheet may be display board or cardboard, chipboard or any material which can be die cut and is readily tearable. The tab 14 is produced by die cutting the sheet 16 and has a keyhole shape including a rounded, that is, circular or oval, free end 18 and an integral stem 20, which after die cutting remains attached to the sheet 16. As seen in the above-mentioned Figures, a keyhole-shaped aperture 22 is produced in the sheet 16 when the tab 14 is pressed out from the sheet. The tab may be bent slightly out of the plane of sheet 16 or folded down.

In the preferred embodiment, a transverse slit is located below each tab 14 and each aperture 22 is associated with a tab 14. The slit 24 pierces the sheet 16 and may be produced in the same die cutting operation when the tabs 14 are produced.

Articles of any type may be displayed on the card 10. If the product is of suitable size, it may be mounted directly on a tab 14. Other products may be carded, blister packed or packaged. A package for a product is shown in the drawing but the words "articles" and "packaged products" are intended to represent all forms of articles that may be displayed on card 10.

The packages 12 include a flat header 26 at the top attached to a bag portion 28. A hole 30 passes through the header 26. The rounded free end 18 of the tab 14 has a transverse dimension greater than the diameter of the hole 30 in the bag header 26. The package 12 is attached to the display card 10 of this invention by the insertion of the tab 14 through the hole 30 in the header 26. Flexing of the tab 14 permits passage through the hole 30 although the tab has the greater dimension as stated above. Attachment of the package 12 is further facilitated when the header 26 is also of flexible material as is frequently the case in the packaging of cosmetics, candy, small articles of hardware, snacks and the like.

To remove a package 12 from the display card 10 it is only necessary to lightly grasp the package 12 and pull casually in the direction indicated in the Figures by the arrow 32. This causes the sheet 16 to tear through stem 20. However, in many instances the sheet will tear downward from the cut edge of the aperture 22 until the aperture is extended to reach the slit 24 at which point the tab 14 separates from the sheet 16. The location of the slit 24 prevents the tear from extending beyond the slit 24 and preserves the appearance of the display card 10. In FIGS. 1 to 3 the torn portion of the sheet 16 is indicated by the reference numeral 34 to distinguish the torn edges from the die cut edges in the sheet 16.

It should be apparent that the packages 12 can be arranged on the display card 10 in any pattern, for example, the two vertical rows illustrated in FIG. 1. The spacing between tabs is selected to accomodate the dimensions and bulk of the packages 12. Mounting holes 36 are provided near the upper end of the display card 10 so that the entire display card 10 with its packages may be hung from hooks, nails, and the like for purposes of display.

It should be noted that the packages 12 are permanently attached to the display card 10 once the tab 14 is inserted in the header hole 30 and the rounded free end 18 of the tab 14 returns to its unflexed condition due to the natural resiliency of the material which has been selected for fabrication. The package 12 may then be removed from the display card 10 only by a deliberate flexing of the tab 14 and its reverse passage through the header opening 30, or in its intended use as described above, by pulling on the package until the tab 14 is torn off. Accordingly, the products in the packages 12 may be attached to the display card 10 at the point of origin in the factory and the packages will remain properly attached during transportation to the point of sale.

Figure 4:
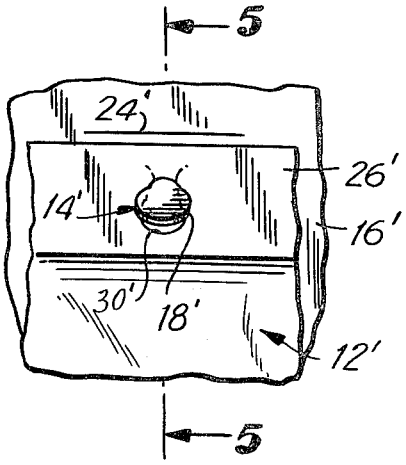
FIG. 4 is a fragmentary front view showing alternative embodiments of this invention.
Figure 5:
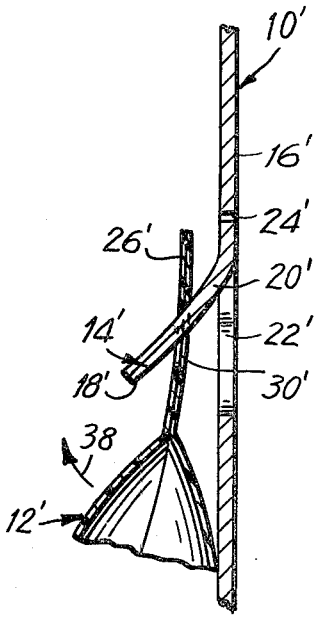
FIG. 5 is a sectional view taken along the line 5—5 of FIG. 4.

Because the free rounded end 18 of the tab 14 retains the package 12 because of the difference in dimensions between the tab and the header hole 30, it should be readily apparent that in an alternative embodiment of this invention, shown in FIGS. 4 and 5, the apertures 22' are inverted. That is, the aperture 22' in the sheet 16' has its rounded end below the elongated rectangular stem portion. Also, the slit 24' is located above the tab 14' when the package 12' is attached to the display card 10' in the manner as described above, namely, by inserting the rounded end 18' of the tab 14' through the hole 30' in the package header 26'. As before, the dimension of the rounded end 18' of the tab 14' exceeds the diameter of the header hole 30'.

The package 12' is held to the card 10' with less bending of the tab 14' than in the first embodiment. In normal usage, the package 12' is removed from the display card 10' by grasping the package 12' and pulling in the generally outward and upward direction as indicated by the arrow 38 so as to tear the tab 14' until the torn portion intersects the slit 24' and the tab and the package 12' are separated from the display sheet 16'. With a straight downward pull, the tab will be torn through stem 20'.

Although in the embodiments described above and shown in the drawings, a package is illustrated with one hole in the header portion, it should be understood that two or more holes disposed horizontally in the header may be used to prevent tilting of the package on the display card 10. In such a case, the number of tabs will correspond to the number of holes in the header. Further, it should be understood that any package having a hole of suitable cross-section at the top through which the tab may be inserted, as described above, is suited for attachment to the display card of this invention. Also, bag type packages which have no header may also be mounted by using the tabs inserted through holes in the opposed sides of the bag.

In another alternative embodiment of this invention, the slit 24 need not pass entirely through the sheet 16, and in further alternative embodiments of this invention the slit 24 may not be continuous but may be in the nature of closely spaced perforations.

Additionally, whereas the free end 18 of the tab 14 has been described as being rounded, in alternative embodiments of this invention the free end of the tab may have other shapes, for examples, oval, or in the form of an arrowhead with the end point of the arrow being the farthest extremity of the tab and the side points of the arrow being spaced further apart than the diameter of the opening at the top of the package.

The exposed face of the display card 10 may be covered with a design which is ornamental or instructive printing and which is incrementally exposed as the packages are removed from the display card.

Further, whereas the hole 30 in the header 26 has been illustrated in the Figures as circular, it should be understood that the display card of this invention will effectively hold packages or articles when the header hole is in other shapes, e.g., oval or elongated, so long as the width of the hole is less than the width of the free end 18 of the tab 14. It should also be realized that the tab 14 will be effective when the header hole is a vertical slot having a vertical height in excess of the maximum width of the tab free end 18. In such a usage, the tab 14 may be inserted in the header hole without flexing of the tab, and the sheet 16 need only be tearable but not necessarily flexible. While such articles will be properly held for display by the display card of this invention, it may be possible for the articles to inadvertently be detached from the display card, for example, due to vibration during shipment of packages already mounted to the display card.

Also, it will be apparent that the slit serves to stop the tearing of the sheet material and thereby preserve an attractive appearance until all articles have been removed. In an alternative embodiment, the tabs serve their intended purpose in retaining articles even without the associated slits. Such card may be subject to extensive uncontrolled tearing when articles are pulled off. Effectively controlled tearing has been provided when the slit is positioned away from the attached tab end by a distance approximately equalling the width of the attached tab end.

In another alternative embodiment of this invention, the sheet 16 may be fabricated of a non-tearable material which is flexible. In such an embodiment, the tab 14 is inserted in the hole 30 of the package 12 as described above, however, in removing the package from the display board 10, the package is released when the tab end 18 flexes as tension is applied by pulling on the package 12. The flexed tab 14 then passes through the hole 30 in the header 26 of the package 12 in a reversal of the motion by which the package 12 was originally attached to the display card. No card tearing occurs and the display card is reusable.

In yet another alternative embodiment of the display card of this invention, the sheet 16 and the tab 14 are neither tearable nor flexible. Cooperating with such an embodiment of this invention, the article or package 12 to be displayed on the card 10 has a hole 30 which is formed in flexible material. The package 12 is attached to the display card by forcing the inflexible tab 14 against the flexible opening, whereby the opening extends allowing the tab to pass through whereby the package is secured as described above. To remove the package from the tab, the package is pulled causing the flexible opening in the package to extend or tear such that the tab passes through the opening and thereby the package is released. No card tearing occurs and the display card is reusable.

In the description of embodiments of the invention presented above, the tabs are formed as integral portions of the display card. However, in another alternative embodiment of the display card of this invention, the tabs may be independent components which are attached to a sheet 16 of material by any suitable means to form a display card having the same performance characteristics as the card with integral tabs as described above. For example, the tabs may be attached to the front of the sheet by means of a metal staple, rivet, grommet, adhesive, etc. In such an embodiment, the sheet needs no apertures 22.

Further, the tabs may extend through the sheet and be anchored by any suitable means at the rear of the sheet. In such an embodiment, the tab passes through a slit or other aperture in the sheet and is secured at the attached end by, for examples, a staple, rivet, adhesive, etc.

Also, the independent tab may be double ended, that is, shaped generally as a dumbbell with two enlarged ends connected together by a narrower stem portion. In such an embodiment, the sheet 16 includes an opening, of lesser dimension than the enlarged tab end, through which the tab is inserted. No external fastener, such as rivets, adhesive, staple, is required. The tab is held at one end to the sheet 16 in the same manner as the package is held at the other tab end to the tab. It should be understood that with a display card having such openings for use with double-ended tabs as described above, the tab may be formed as an integral part of the package. That is, the keyhole tab extends from the package, and the package is attached to the display card by inserting the enlarged free end of the tab through a properly dimensioned hole in the display card.

In the above alternative embodiments wherein the tab is not integral with the display card, it should be understood that combinations of flexible, inflexible and tearable materials may be made as suits the application. Key factors in making card and tab material selections include desired reusability of the card and the nature of the hole in the package or article.

It will thus be seen that the objects set forth above, among those made apparent from the preceding description, are efficiently attained and, since certain changes may be made in the above construction without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. A display card for holding an article, said article having a hole therein, comprising:

a sheet comprising a tearable material;

a tab, said tab being attached at one end to said sheet, the other end of said tab being free and extending away from said sheet, at least a portion of said free end of said tab being wider than the width of at least a portion of said attached end of said tab and the width of said hole in said package, said tab being insertable through said hole, whereby, because of said width differential between said tab and said hole, said article is retained on said card after insertion of said tab through said hole, and said article may be removed from said card by pulling said article;

a slit in said sheet, said slit being proximate but not touching said attached tab end, said slit limiting the possible extent of any tearing of said sheet when said article is pulled in the direction of said slit for removal of said article from said display card.

2. A display card for holding an article as claimed in claim 1 wherein said tab is integral with said sheet and further comprising an aperture in said sheet, said aperture being formed by cutting and extending said tab.

3. A display card for holding an article as claimed in claims 1 or 2 wherein said tab has a keyhole shape.

4. A display card for holding an article as claimed in claims 1, or 2 wherein said tab is flexible and said tab width of said portion at said free end exceeds the span in any direction of said hole in said article.

5. A display card for holding an article as claimed in claim 1 or 2 wherein said slit is substantially transverse to the longitudinal direction of said tab.

6. A display card for holding an article as claimed in claim 1 or 2 wherein the distance between said slit and said attached tab end is approximately equal to the width of said attached end.

7. A display card for holding an article as claimed in claim 1 or 2 wherein said slit is linear.

8. A display card for holding an article as claimed in claim 1 or 2 wherein said slit pierces said sheet.

9. A display card for holding an article as claimed in claim 1 or 2 wherein said slit is below said attached end of said tab.

10. A display card for holding an article as claimed in claim 1 or 2 wherein said slit is above said attached end of said tab.

11. The display card of claim 1 or 2 in combination with a package, said package having said hole therein.

12. A display card for holding an article as claimed in claims 1 or 2 and further comprising additional tabs extending from the face of said sheet whereby a plurality of articles may be retained on one card.

13. A display card for holding an article as claimed in claims 1 or 2 wherein said tab is rigid and said hole in said article is formed in flexible material.

14. Means for attachment of an article for display, comprising:

a sheet;

a tab, said tab attached at one end to said sheet and at the other end to said article for display, at least one end of said tab having a portion of enlarged width, said enlarged portion extending through an opening of lesser width whereby said attachment of said at least one end is accomplished;

a slit in said sheet, said slit being proximate but not contiguous with said attached tab end, said slit limiting the possible extent of any tearing of said sheet when said article is pulled in the direction of said slit for removal of said article from said display card.

* * * * *